United States Patent [19]

Terada et al.

[11] 4,440,132

[45] Apr. 3, 1984

[54] FUEL INJECTION SYSTEM

[75] Inventors: Tomohiko Terada; Hideaki Komada, both of Higashi Matsuyama, Japan

[73] Assignee: Diesel Kiki Company, Ltd., Tokyo, Japan

[21] Appl. No.: 341,041

[22] Filed: Jan. 19, 1982

[30] Foreign Application Priority Data

Jan. 24, 1981 [JP] Japan ..... 56-9168

[51] Int. Cl.[3] ..... F02M 57/02; F02M 39/00

[52] U.S. Cl. ..... 123/446; 123/458; 123/467; 123/500; 239/88; 239/585

[58] Field of Search ..... 123/446, 447, 467, 502, 123/501, 500, 357, 458

[56] References Cited

U.S. PATENT DOCUMENTS

| | | | |
|---|---|---|---|
| 3,908,621 | 9/1975 | Hussey | 123/447 |
| 4,019,481 | 4/1977 | Lakra | 123/447 |
| 4,069,800 | 1/1978 | Kanda | 123/447 |
| 4,211,202 | 7/1980 | Hafner | 123/467 |
| 4,249,497 | 2/1981 | Eheim | 123/446 |
| 4,359,032 | 11/1982 | Ohie | 123/467 |
| 4,364,360 | 12/1982 | Eheim | 123/501 |
| 4,378,775 | 4/1983 | Straubel | 123/501 |

*Primary Examiner*—Charles J. Myhre
*Assistant Examiner*—Carl Stuart Miller
*Attorney, Agent, or Firm*—Jordan and Hamburg

[57] ABSTRACT

A fuel injection system has a fuel supply line which extends from a fuel reservoir to a fuel injector through a booster and is hydraulically isolated from a hydraulic circuit for operating the booster and a hydraulic circuit for operating a nozzle needle actuator, which is operatively associated with the fuel injector to control fuel injection. The two hydraulic circuits share a common source of hydraulic fluid supply which is independent of the fuel reservoir and adapted to actuate general hydraulic units. An electronically operated pressure control valve is controlled by a control unit to drive the booster with a hydraulic fluid pressure which varies in proportion to a varying engine load, i.e. full load, partial load and no load.

6 Claims, 2 Drawing Figures

FUEL INJECTION SYSTEM

Background of the Invention

The present invention generally relates to fuel injection systems for Diesel engines and, more particularly, to a fuel injection system of the type which includes a booster for boosting the pressure of fuel to be supplied to a fuel injector and a nozzle needle actuator for controlling a fuel injection from the fuel injector in response to a control of a hydraulic fluid pressure applied thereto.

A fuel injection system of the type described is disclosed in Japanese Patent application No. 55-87451/1980. This prior art fuel injection system is constructed to operate the booster and nozzle needle actuator by a hydraulic pressurized fluid which is the fuel to be injected. That is, fuel is circulated through the additional lines for operating the booster and nozzle needle actuator in addition to the fuel supply line to the fuel injector. This is undesirable, however, in view of the current situation of worldwide oil supply and, therefore, the future use of crude fuel. Crude fuel would permit various impurities such as tar and pitch contained therein to become deposited on direction control valves, booster, nozzle needle actuator, pipings and the like, rendering the operations of such elements unsmooth or erroneous. This would critically affect the control over the fuel injection by the fuel injector.

SUMMARY OF THE INVENTION

A fuel injection system embodying the present invention comprises a source of fuel supply or fuel reservoir, a booster operated by a pressure differential between opposite ends thereof to compress fuel fed from the fuel reservoir to one end thereof, the fuel developing a first hydraulic fluid pressure, a fuel injector for injecting a supply of compressed fuel from the booster, a nozzle needle actuator operatively associated with the fuel injector and operated by a pressure differential between opposite ends thereof to start and terminate a fuel injection from the fuel injector, a source of hydraulic fluid supply or fluid reservoir, a first hydraulic circuit means for producing a predetermined hydraulic fluid pressure and communicated with the fluid reservoir, a pressure control means for controlling the predetermined hydraulic fluid pressure in the first hydraulic circuit means and supplying the controlled pressure to the other end of the booster through a first direction control means as a second hydraulic fluid pressure, a second hydraulic circuit means for selectively communicating through a second direction control means one end of the nozzle needle actuator to the first hydraulic circuit means and the fluid reservoir, a third hydraulic circuit means for selectively communicating through a third direction control means the other end of the nozzle needle actuator to the fluid reservoir when said one end is communicated to the first hydraulic circuit means and to the first hydraulic circuit means when said one end is communicated to the fluid reservoir, and a control means for controlling the output level of the pressure control means and the states of the first to third direction control means.

In accordance with the present invention, a fuel injection system has a fuel supply line which extends from a fuel reservoir to a fuel injector through a booster and is hydraulically isolated from a hydraulic circuit for operating the booster and a hydraulic circuit for operating a nozzle needle actuator, which is operatively associated with the fuel injector to control fuel injection. The two hydraulic circuits share a common source of hydraulic fluid supply which is independent of the fuel reservoir and adapted to actuate general hydraulic units. An electronically operated pressure control valve is operated by a control unit to drive the booster with a hydraulic fluid pressure which varies in proportion to a varying engine load, i.e. full load, partial load and no load.

It is an object of the present invention to provide a fuel injection system which can accommodate the expected use of crude fuel without affecting any element allotted for the control of fuel injection.

It is another object of the present invention to provide a fuel injection system in which a unique arrangement of a pressure control valve causes the booster to operate in accordance with a varying engine load while preventing a booster operating pressure from affecting a nozzle needle operating pressure, despite the use of a common hydraulic fluid source.

It is another object of the present invention to provide a generally improved fuel injection system.

Other objects, together with the foregoing, are attained in the embodiment described in the following description and illustrated in the accompanying drawings.

DESCRIPTION OF THE PREFERRED EMBODIMENTS

While the fuel injection system of the present invention is susceptible of numerous physical embodiments, depending upon the environment and requirements of use, substantial numbers of the herein shown and described embodiment have been made, tested and used, and all have performed in an eminently satisfactory manner.

Figure 1:
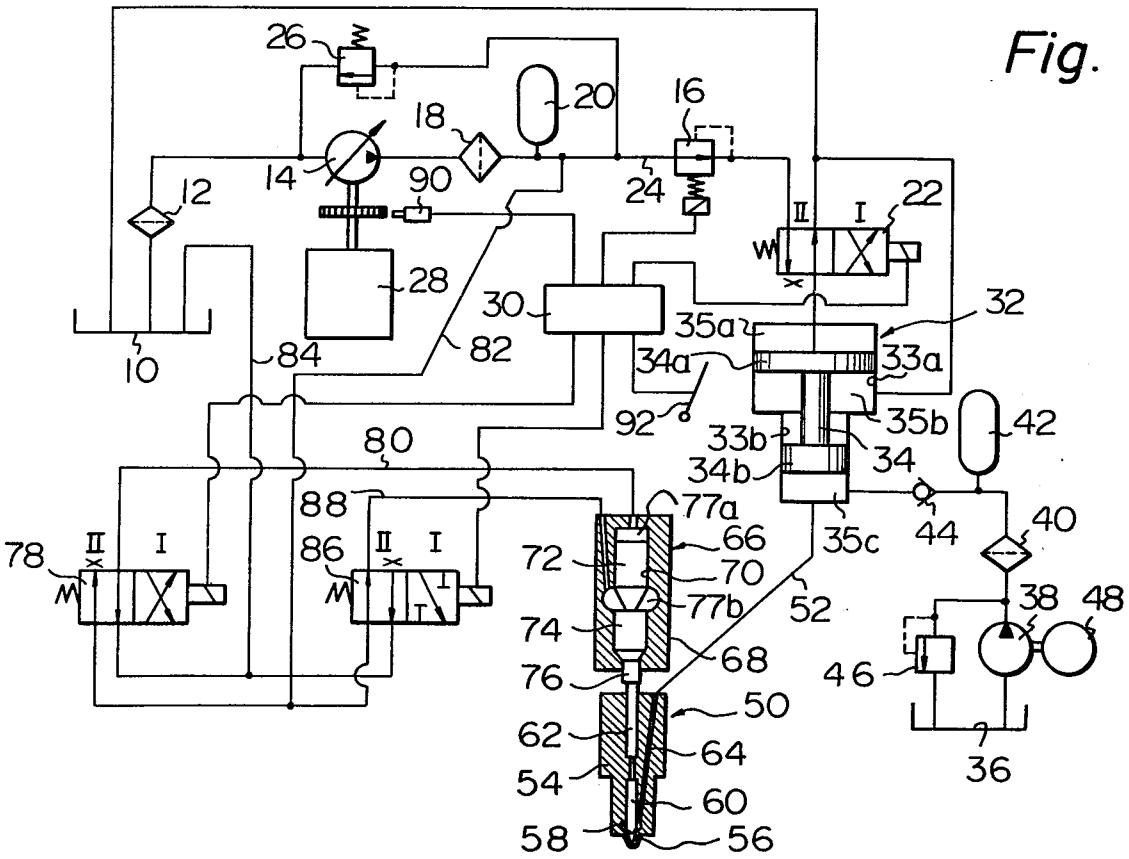
FIG. 1 is a diagram showing an overall construction of a fuel injection system embodying the present invention.

Referring to FIG. 1 of the drawings, the fuel injection system includes a source of hydraulic fluid supply or reservoir 10 which stores a hydraulic fluid substantially under atmospheric pressure for operating various hydraulic units. The reservoir 10 is communicated via a filter 12 to the suction port of a hydraulic pump 14 whose delivery port is communicated to an electronically operated pressure reducing or control valve 16 via a filter 18 and an accumulator 20. The pressure control valve 16 is in fluid communication with an electromagnetically operated 2-position, 4-port direction control valve or selector 22. The fluid delivery line from the pump 14 to the direction control valve 22 will be referred to as a first hydraulic circuit and denoted by the reference numeral 24. A relief valve 26 is communicated with the first hydraulic circuit 24 to maintain the fluid pressure in the circuit 24 at a preselected constant level. The pump 14 is driven for rotation by an engine 28. Operated by a control unit 30 as will be described, the pressure control valve 16 controls its constant input pressure in accordance with the varying load on the engine 28, i.e. full load, partial load and no load. This controlled output of the valve 16 is fed to the direction control valve 22.

A booster generally designated by the reference numeral 32 comprises intercommunicated upper and lower bores 33*a* and 33*b*. The upper bore 33*a* is larger in diameter than the lower bore 33*b*. A servo piston 34 is slidably disposed in the upper and lower intercommunicated bores 33*a* and 33*b* and has an upper piston 34*a* and lower piston 34*b* which correspond in diameter to the upper and lower bores 34*a* and 34*b*, respectively. The upper piston 34*a* thus larger than the lower piston 34*b* defines a chamber 35*a* thereabove and a chamber 35*b* therebelow. The chamber 35*a* is selectively communicatable to the fluid reservoir 10 and the pressure control valve 16 depending on the position of the direction control valve 22. The chamber 35*b* is held in constant communication with the fluid reservoir 10. The lower piston 34*b* on the other hand defines a chamber 35*c* therebelow for compressing a supply of fuel when the servo piston 34 strokes downward. This chamber 35*c* has fluid communication with a source of fuel supply or fuel reservoir 36 and a fuel injection nozzle or fuel injector 50.

The fuel reservoir 36 connects to a hydraulic pump 38 which in turn connects to the chamber 35*c* of the booster 32 via a filter 40, an accumulator 42 and a check valve 44. A relief valve 46 is communicated with the delivery side of the pump 38 to maintain the delivery pressure of the pump 38 constant. The pump 38 is driven by a drive 48 to suck fuel from the reservoir 36 and compress it.

The direction control valve 22 has two positions I and II which are alternately selected by the control unit 30. In the position I of the valve 22, the upper or piston chamber 35*a* of the booster 32 is allowed to communicate with the pressure control valve 16 so that the fluid under controlled pressure from the valve 16 is admitted in the piston chamber 35*a* to move the servo piston 34 downward. Then, the fuel filled in the lower or compression chamber 35*c* is compressed and fed to a fuel injector 50 by way of a conduit 52. In the position II of the valve 22, the piston chamber 35*a* is brought into communication with the fluid reservoir 10 while fuel is fed under pressure from the pump 38 into the compression chamber 35*c*. This causes the servo piston 13 into an upward stroke by the fuel pressure in the compression chamber 35*c*. The booster 32 in this embodiment is designed such that a supply of fuel in the compression chamber 35*c* is boosted to a pressure which is about six times the regulated delivery pressure of the pump 38, when the position of the valve 24 is varied from II to I.

The fuel injector 50 comprises a body 54 which is formed with nozzle holes 56 and a fuel well 58 contiguous with the nozzle holes 56. A nozzle needle 60 is slidably received in the nozzle body 54 and normally seated on a nozzle needle seat by a pressure imparted downwardly thereto from a pressure pin 62 so as to keep the nozzle holes 56 closed. A fuel induction passage 64 extends through the nozzle body 54 to provide fluid communication between the conduit 52 and the fuel well 58.

A nozzle needle actuator 66 is disposed above and operatively associated with the fuel injector 50. As shown, the nozzle needle actuator 66 comprises a body 68 which has an axially extending bore 70 therein. A first piston 72 is slidably received in the bore 70 and has a tapered end which is directed downward. Also received in the bore 70 is a second piston 74 which is positioned below and coaxially with the first piston 72. A rod 76 extends downward from the lower end of the second piston 74 which is remote from the tapered end of the first piston 72. The rod 76 constantly rests on the upper end of the pressure pin 62 which is slidably received in the upper end of the nozzle body 54. The upper piston 72 defines a chamber 77*a* in cooperation with the actuator body 68 while the lower piston 74 defines a chamber 77*b* in cooperation with the actuator body 68.

A second direction control valve or selector 78 is communicated with the upper chamber 77*a* of the actuator body 68 by a second hydraulic circuit 80. The valve 78, like the valve 22, is of the electromagnetically operated 2-position, 4-port type and electrically connected with the control unit 30. The valve 78 selectively communicates the second hydraulic circuit 80 and, therefore, the chamber 77*a* to the first hydraulic circuit 24 via a fluid supply line 82 and to the fluid reservoir 10 via a fluid return line 84. The fluid supply line 82 branches off the first hydraulic circuit 24 downstream of the pump 14 and upstream of the pressure control valve 16.

A third direction control valve or selector 86 is communicated with the lower chamber 77*b* by a third hydraulic circuit 88. Again, the valve 86 is of the electromagnetically operated 2-position, 4-port type and electrically connected with the control unit 30. The valve 86 selectively communicates the third hydraulic circuit 88 to the first hydraulic circuit 24 via the fluid supply line 82 and to the fluid reservoir 10 via the fluid return line 84.

An engine speed sensor 90 and a throttle position sensor 92 are electrically connected with the control unit 30 to supply electric signals indicative of an engine speed and a throttle lever position, respectively. The control unit 30 processes these input signals as well as others to produce control signals for actuating the respective direction control valves 22, 78 and 86.

In operation, the hydraulic motor 14 is driven for rotation by the engine 28 to compress the hydraulic fluid which it sucks from the reservoir 10. The fluid pressure in the first hydraulic circuit 24 is controlled by the relief valve 26 to below a predetermined level. This substantially constant fluid pressure is modified by the pressure control valve 16 under the control of the control unit 30, in proportion to the varying engine load.

When the first direction control valve 22 is in the I position, the fluid pressure from the pressure control valve 16 is admitted in the piston chamber 35*a* of the booster 32 via the valve 22. The fluid pressure urges the servo piston 34 downward though the compression chamber 35*c* is filled with fuel in the previous II position of the valve 22. The servo piston 34 in a downward stroke compresses the fuel in the compression chamber 35*c* and this booster output is fed to the fuel injector 50 via the conduit 52. The fuel from the conduit 52 flows through the induction passage 64 of the nozzle body 54 to fill the fuel well 58 which is communicated with the nozzle holes 56. It will be seen that the resultant fluid pressure in the fuel well 58 is dependent on the volume of the pressurized fluid admitted in the piston chamber 35*a* of the booster 32, that is, the output pressure of the pressure control valve 16 which is controlled by the varying engine load through the control unit 30.

Figure 2:
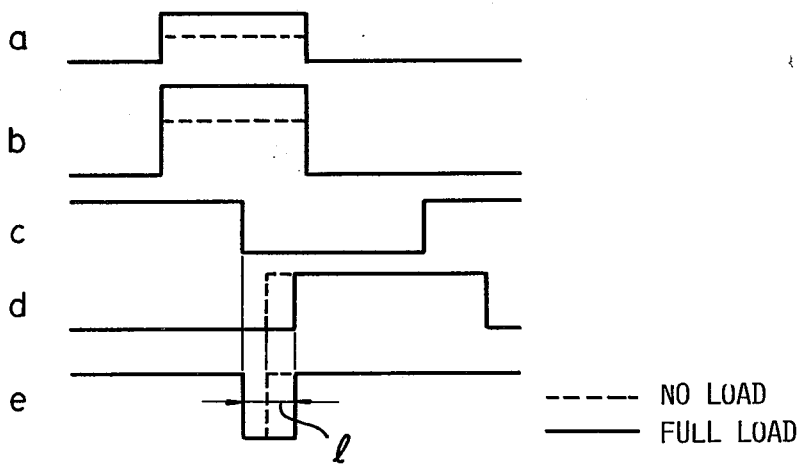
FIG. 2 is a timing chart demonstrating operations of a booster and a nozzle needle actuator included in the fuel injection system of FIG. 1 in terms of variations in hydraulic fluid pressure.

The pressure variations in the upper and lower chambers 35*a* and 35*c* of the booster 32 are represented by waveforms a and b in FIG. 2, respectively. In each of the waveforms a and b, a solid line corresponds to a full engine load condition and a phantom line to a no engine load condition.

When the second direction control valve 78 is shifted from the I position to the II position, the upper chamber 77*a* of the nozzle needle actuator 66 is drained to the fluid reservoir 10 via the second hydraulic circuit 80, valve 78 and fluid return line 84, causing the pressure inside the chamber 77*a* to drop abruptly to the atmospheric level. Then, the fluid pressure in the fuel well 58 of the fuel injector 50 lifts the nozzle needle 60 together with the pistons 74 and 72, so that the nozzle holes 56 are unblocked to start a fuel injection. In the meantime, the lower chamber 77*b* of the nozzle needle actuator 66 is drained to the reservoir 10 via the third hydraulic circuit 88, valve 86 and fluid return line 84.

When the third direction control valve 86 is shifted from the II position back to the I position, the lower chamber 77*b* of the nozzle needle actuator 66 is caused into communication with the first hydraulic circuit 22 via the third hydraulic circuit 88, valve 86 and fluid supply line 82. The fluid pressure thus delivered from the first hydraulic circuit 22 to the chamber 77*b* overcomes the pressure which is acting on the pressure stage of the nozzle needle 60 to lift the nozzle needle 60. As a result, the lower piston 74 is moved downward to rest on the valve seat and thereby terminate the fuel injection from the nozzle holes 56. Waveforms c and d in FIG. 2 indicate the interrelated variations in the fluid pressures developing in the chambers 77*a* and 77*b* of the nozzle needle actuator 66, respectively. These properly timed pressure variations in the chambers 77*a* and 77*b* determine the fuel injection characteristic (pressure in the fuel well 58) as indicated by a waveform e, in which l shows a duration of fuel injection. Again, the solid lines correspond to a full load engine operating condition and the phantom lines to a no load engine operating condition.

In summary, it will be seen from the foregoing that the present invention provides a fuel injection system which can safeguard various fuel injection control elements against deposition of impurities in spite of the current tendency to the use of crude fuel.

Where a common hydraulic fluid source is shared by the booster circuit and fuel injection control circuit, the nozzle needle actuator controlling fuel injection will be adversely affected by the variable fluid pressure which operates the booster. The present invention safely realizes such common use of a single hydraulic fluid source for the booster circuit and fuel injection control circuit by controlling the booster operating pressure with an electronic pressure control valve disposed in the first hydraulic circuit, while supplying the fuel injection control circuit with a fluid pressure from the first hydraulic circuit upstream of the pressure control valve.

Various modifications will become possible for those skilled in the art after receiving the teachings of the present disclosure without departing from the scope thereof.

What is claimed is:

1. A fuel injection system comprising:

a source of fuel supply;

a booster operated by a pressure differential between opposite ends thereof to compress fuel fed from the source of fuel supply to one end thereof, the fuel developing a first hydraulic fluid pressure;

a fuel injector for injecting a supply of compressed fuel from the booster;

a nozzle needle actuator operatively associated with the fuel injector and operated by a pressure differential between opposite ends thereof to start and terminate a fuel injection from the fuel injector;

a source of hydraulic fluid supply;

first hydraulic circuit means for producing a predetermined level of hydraulic fluid pressure and communicated with the source of hydraulic fluid supply;

a pressure control means for controlling the predetermined hydraulic fluid pressure in the first hydraulic circuit means and supplying the controlled pressure to the other end of the booster through a first direction control means as a second hydraulic fluid pressure;

second hydraulic circuit means for selectively communicating through a second direction control means one end of the nozzle needle actuator to the first hydraulic circuit means and the source of hydraulic fluid supply;

a third hydraulic circuit means for selectively communicating through a third direction control means the other end of the nozzle needle actuator to the source of hydraulic fluid supply when said one end is communicated to the first hydraulic circuit means and to the first hydraulic circuit means when said one end is communicated to the source of hydraulic fluid supply; and a control means for controlling the output pressure of the pressure control means and the states of the first to third direction control means.

2. A fuel injection system as claimed in claim 1, in which the pressure control means comprises an electronically operated pressure reducing valve, the control means being constructed to control the pressure reducing valve in accordance with a predetermined parameter of engine operation.

3. A system as claimed in claim 2, in which the engine operation parameter is an engine load.

4. A system as claimed in claim 3, in which the control means is constructed to process electric output signals of an engine speed sensor and a throttle position sensor.

5. A system as claimed in claim 1, in which the first hydraulic circuit means includes a hydraulic pump driven by an engine while being communicated with the fluid source and a relief valve.

6. A system as claimed in claim 1, in which each of the direction control means comprises a 2-position, 4-port direction control valve or selector.

* * * * *